US008499502B2

(12) United States Patent
Browe et al.

(10) Patent No.: US 8,499,502 B2
(45) Date of Patent: Aug. 6, 2013

(54) DISPLAY FOR A CASKET SELECTION ROOM

(75) Inventors: Jane Browe, Cincinnati, OH (US); Diana Burkhart, Pensacola Beach, FL (US)

(73) Assignee: Batesville Services, Inc., Batesville, IN (US)

( * ) Notice: Subject to any disclaimer, the term of this patent is extended or adjusted under 35 U.S.C. 154(b) by 2842 days.

(21) Appl. No.: 10/836,766

(22) Filed: Apr. 30, 2004

(65) Prior Publication Data

US 2005/0241251 A1 Nov. 3, 2005

(51) Int. Cl.
*E04F 19/00* (2006.01)
*A47G 29/00* (2006.01)

(52) U.S. Cl.
USPC ..... 52/36.4; 52/311.1; 312/322; 211/85.6

(58) Field of Classification Search
USPC .... 52/311.1, 36.1, 36.4, 36.5, 38; 211/85.16, 211/85.27, 80, 81, 168, 165; 312/139.1, 312/322
See application file for complete search history.

(56) References Cited

U.S. PATENT DOCUMENTS

| | | | | |
|---|---|---|---|---|
| 518,335 | A | 4/1894 | Sherman | 27/27 |
| 1,842,286 | A | 1/1932 | Potter | 312/293.2 |
| 2,665,184 | A | 1/1954 | Hord | 312/293.2 |
| 3,190,243 | A | 6/1965 | Pira | 211/134 X |
| 3,191,320 | A | 6/1965 | Copeland et al. | |
| 4,082,384 | A | 4/1978 | Dold | 312/278 X |
| 4,140,224 | A | 2/1979 | Celeste | |
| 4,160,570 | A | 7/1979 | Bridges | 211/88.01 |
| 4,304,076 | A | 12/1981 | Splendora | |
| 4,403,700 | A | 9/1983 | Manlove | 312/245 X |
| 4,508,231 | A | 4/1985 | Honickman | |
| 4,615,448 | A | 10/1986 | Johnstonbaugh | 211/94 |
| 4,688,359 | A | 8/1987 | See | 52/134 |
| 4,825,601 | A | 5/1989 | Halverson | |
| D308,147 | S * | 5/1990 | Pei-Ai | D6/559 |
| 4,930,628 | A | 6/1990 | Bridges | 312/245 X |
| 5,333,744 | A | 8/1994 | LoCicero et al. | 211/87 |
| 5,405,017 | A | 4/1995 | Szabo, Sr. et al. | |
| 5,495,954 | A | 3/1996 | Schmidt | 211/90.04 |
| 5,524,394 | A | 6/1996 | Szabo, Sr. et al. | |

(Continued)

FOREIGN PATENT DOCUMENTS

| | | |
|---|---|---|
| FR | 2 542 492 | 9/1984 |
| FR | 2674735 | 10/1992 |

(Continued)

OTHER PUBLICATIONS

Batesville Casket Company, Inc./Applied Retail Systems, *Partnership Marketing Program*, Brochure, 38 pages, undated.

(Continued)

*Primary Examiner* — William Gilbert
(74) *Attorney, Agent, or Firm* — Wood, Herron & Evans, LLP

(57) ABSTRACT

A display for displaying the features of a casket which has a shell, a lid and an interior, comprises a wall, a cabinet mounted to the wall, an openable and closable door mounted to the cabinet, the door having the appearance of being at least a portion of the lid of the casket, and at least a portion of the shell of the casket positioned in the cabinet.

46 Claims, 7 Drawing Sheets

U.S. PATENT DOCUMENTS

| | | | | |
|---|---|---|---|---|
| 5,526,943 | A | 6/1996 | Thompson | 211/87.01 |
| 5,622,010 | A | 4/1997 | Weber | 52/36.4 |
| 5,707,126 | A | 1/1998 | Neufeld et al. | 312/245 |
| 5,709,052 | A | 1/1998 | Szabo, Sr. et al. | |
| 5,755,499 | A | 5/1998 | Hillesland | 312/245 |
| 5,759,045 | A | 6/1998 | Gabig et al. | |
| 5,787,626 | A | 8/1998 | Bingham et al. | 40/735 |
| D398,026 | S | 9/1998 | Riga | |
| D398,027 | S | 9/1998 | Riga | |
| D398,654 | S | 9/1998 | Riga | |
| 5,800,027 | A | 9/1998 | Dunn | 312/245 |
| D399,880 | S | 10/1998 | Riga | |
| 5,848,498 | A | 12/1998 | Szabo, Sr. et al. | 27/27 |
| 5,848,698 | A | 12/1998 | Stompe | 40/661.08 |
| D405,583 | S | 2/1999 | Zimmerman | |
| 5,901,862 | A | 5/1999 | Riga et al. | 211/85.16 |
| 6,073,320 | A | 6/2000 | Salatin et al. | 27/27 |
| 6,076,906 | A * | 6/2000 | Royal | 312/273 |
| 6,145,671 | A | 11/2000 | Riga et al. | 27/27 |
| 6,145,672 | A | 11/2000 | Bachman et al. | 211/13.1 |
| D440,796 | S | 4/2001 | Riga | D6/468 |
| 6,276,034 | B1 | 8/2001 | Bachman et al. | 27/27 |
| 6,467,634 | B1 | 10/2002 | Pinco | 211/85.16 |
| 7,036,196 | B2 * | 5/2006 | Salatin et al. | 27/27 |
| 2003/0000901 | A1 * | 1/2003 | Salatin et al. | 211/85.16 |

FOREIGN PATENT DOCUMENTS

| | | |
|---|---|---|
| GB | 2224923 | 5/1990 |
| JP | 08 150183 | 6/1996 |
| WO | WO84/02261 | 6/1984 |
| WO | WO89/04129 | 5/1989 |
| WO | WO 96 35404 | 11/1996 |

OTHER PUBLICATIONS

Lajos Szabo, *American Funeral Director*, Feb. 1997, "The Three C's of Selection Rooms", 3 pages.

*Selection Room Display in Public Use* Prior to Aug. 15, 1997, 3 Color Photographs.

Milso Industries, *Milso Renaissance Center*, Advertisement in The American Funeral Director, May 2003, 2 pages.

* cited by examiner

DISPLAY FOR A CASKET SELECTION ROOM

FIELD OF THE INVENTION

This invention relates generally to the funeral service industry, and more particularly to a display system facilitating the selection by a customer of a casket in a funeral home selection room.

BACKGROUND OF THE INVENTION

Funeral home casket selection rooms have evolved as those in the industry have attempted to better meet the funeral customers' needs. The "traditional" presentation of product in a funeral home selection room was to simply place each casket on a bier and open the head end cap or lid of the casket to permit viewing inside the casket. As many caskets as possible were displayed in a selection room in order to maximize the number of product choices for the customer. Unfortunately, such a "traditional" presentation results in what has been referred to as a "sea of caskets" visual effect, which can be both distressing or alarming and confusing to the customer.

Advances in the design of funeral home selection rooms have taken the form of providing a plurality of alcove structures, either of a "modular" construction or of a "stick built" construction, in the funeral home selection room. Each alcove structure includes a vertical back wall and a pair of vertical, spaced apart wing walls cooperating with the back wall to form an alcove. A soffit may span the upper front edges of the wing walls, and lighting, for example track lighting, may be incorporated into the soffit. A two-tier casket rack is located within the alcove, the lower tier of the casket rack being a roll out rack permitting the lower casket to be rolled out from under the upper casket and the casket lid opened for display of the lower casket. Tasteful signage and the like is mounted on the back wall above the caskets. Such a construction, which is the subject of the assignee's prior U.S. Pat. Nos. 5,405,017 and 5,524,394, both hereby incorporated by reference herein, increases the number of caskets which can be displayed in a funeral home selection room, as well as greatly improves the "look and feel" of the casket presentations, thereby reducing the clutter and confusion of the so-called "sea of caskets" effect and providing a feeling of comfort to the families.

New construction and renovation costs being what they are, there is an ever-increasing need to increase the product density displayable in the funeral home selection room, without sacrificing comfort, convenience and look and feel of the casket display systems of U.S. Pat. Nos. 5,405,017 and 5,524,394. To that end, the assignee's U.S. patent application Ser. No. 09/638,576, hereby incorporated by reference herein, discloses a Display For A Casket Selection And/Or Viewing Room. That application discloses the display of a plurality of casket portions along with a plurality of casket information modules. Each information module corresponds to one of the casket portions displayed and houses an insert displaying samples of the various features of the particular casket, for example, a portion of the cap panel, a photo of the casket, a fabric swatch of the casket fabric, etc. To access and view the casket samples displayed on the insert, a door to the module must be opened, and the insert must be slid out of the module.

By way of further advances, the assignee's U.S. patent application Ser. No. 10/611,607, hereby incorporated by reference herein, discloses a Display For A Casket Selection Room. That application discloses a display for a casket selection room comprising a wall, a plurality of casket portions displayed on the wall, and a plurality of casket information modules displayed on the wall. Each information module corresponds to one of the casket portions and includes a photo of the casket, a portion of a cap panel of the casket and/or a fabric swatch of the casket. The photo, portion of the cap panel and/or fabric swatch are visible to the customer without opening the information module. The casket selection display of U.S. patent application Ser. No. 10/611,607 thereby provides further advantages above and beyond the casket selection display disclosed in U.S. application Ser. No. 09/638,576, for example obviating the need to open a door of the casket information module and remove the casket information insert in order to be able to view the same.

"Marquetry" is a decorative wood veneer sheet which is assembled from many separate individual pieces/colors/designs of wood veneer to produce an intricate, ornate pattern, and when applied to a substrate resembles wood "inlay." Marquetry, when applied to a casket lid, gives the resulting casket lid the appearance of being finely tooled and decoratively inlaid. The use of marquetry as decorative surface ornamentation for a molded casket lid is disclosed in the assignee's U.S. patent application Ser. No. 10/261,406, hereby incorporated by reference herein. Various types of decorative surface ornamentation for a casket lid which can be produced from marquetry are disclosed in the assignee's U.S. Design patent application Ser. Nos. 29/176,343, 29/176,342, 29/176,334, 29/176,344, 29/176,345 and 29/176,346, hereby incorporated by reference herein.

It is desirable to provide still further improvements in the area of casket display and selection. In particular, it is desirable to display for selection by a customer a variety of casket portions as in the partial casket displays of the assignee's U.S. patent application Ser. Nos. 09/638,576 and 10/611,607, yet which also provides for display of at least a portion of the lid of the casket, so as to provide customers with an indication of how the actual lid on the actual casket will appear, especially in the case of caskets having lids which include decorative surface ornamentation thereon such as the marquetry mentioned above.

SUMMARY OF THE INVENTION

In one aspect, the present invention is a display for displaying the features of a casket, the casket having a shell, a lid and an interior, the display comprising a wall, a cabinet mounted to the wall, an openable and closable door mounted to the cabinet, the door having the appearance of being at least a portion of the lid of the casket, and at least a portion of the shell of the casket positioned in the cabinet.

The door can be fabricated from wood. The exterior surface of the door can include marquetry thereon.

The display can further include an information module positioned in the cabinet, the information module containing at least a portion of the interior of the casket. The information module can include a photo of the casket, a portion of a cap panel of the casket and/or a fabric swatch of the casket. The information module can comprise an enclosure and an information insert movable into and out of the enclosure. The enclosure can include a door pivotable to and between a closed position and an open position. The information insert can comprise a first portion and a second portion, the first and second insert portions movably mounted to the enclosure for translational movement into and out of the enclosure, the second insert portion movably mounted to the first insert portion for pivoting movement therebetween, whereby the second insert portion can be pulled out of the enclosure and then pivoted 90° such that the contents of the information insert then face the customer. The second insert portion can be fabricated, at least in part, of a transparent material and comprise a first pocket having upper and lower edges, a second pocket attached to the upper edge of the first pocket, and a third pocket attached to the lower edge of the first pocket. The first pocket can include therein a portion of a cap panel of the casket, the second pocket can include therein a photo of the casket and the third pocket can include therein a fabric swatch of the casket.

The portion of the shell of the casket displayed can be a 45° corner cut. The 45° corner cut can be of the shell and lid of the casket.

The door can include at least one of graphics and text on an interior surface thereof relating to the casket.

The wall can be slat wall.

In another aspect, the invention is a display for displaying the features of a casket, the casket having a shell, a lid and an interior, the display comprising a wall, a cabinet mounted to the wall, an openable and closable door mounted to the cabinet, the door having the appearance of being at least a portion of the lid of the casket, at least a portion of the shell of the casket positioned in the cabinet, and at least a portion of the interior of the casket positioned in the cabinet.

In yet another aspect, the invention is a display for a casket selection room comprising a wall, a plurality of cabinets mounted to the wall, a plurality of casket portions representing a plurality of caskets from which a customer may select, each of the plurality of casket portions positioned in one of the plurality of cabinets, and an openable and closable door mounted to each of the plurality of cabinets, the door having the appearance of being at least a portion of a lid of the casket.

In still another aspect, the invention is a display for a casket selection room comprising a wall, a plurality of cabinets mounted to the wall, a plurality of casket portions representing a plurality of caskets from which a customer may select, each of the plurality of casket portions positioned in one of the plurality of cabinets, a plurality of casket interior portions representing a plurality of casket interiors from which a customer may select, each of the plurality of casket interior portions positioned in one of the plurality of cabinets, and an openable and closable door mounted to each of the plurality of cabinets, the door having the appearance of being at least a portion of a lid of the casket.

A major advantage of the present invention is that a partial casket display is provided which also provides for display of at least a portion of the lid of the casket, so as to provide customers with an indication of how the actual lid on the actual casket will appear, especially in the case of caskets having lids which include decorative surface ornamentation thereon such as the marquetry mentioned above.

These and other advantages of the present invention will become more readily apparent during the following detailed description taken in conjunction with the drawings herein, in which:

DETAILED DESCRIPTION OF THE INVENTION

Figure 1:
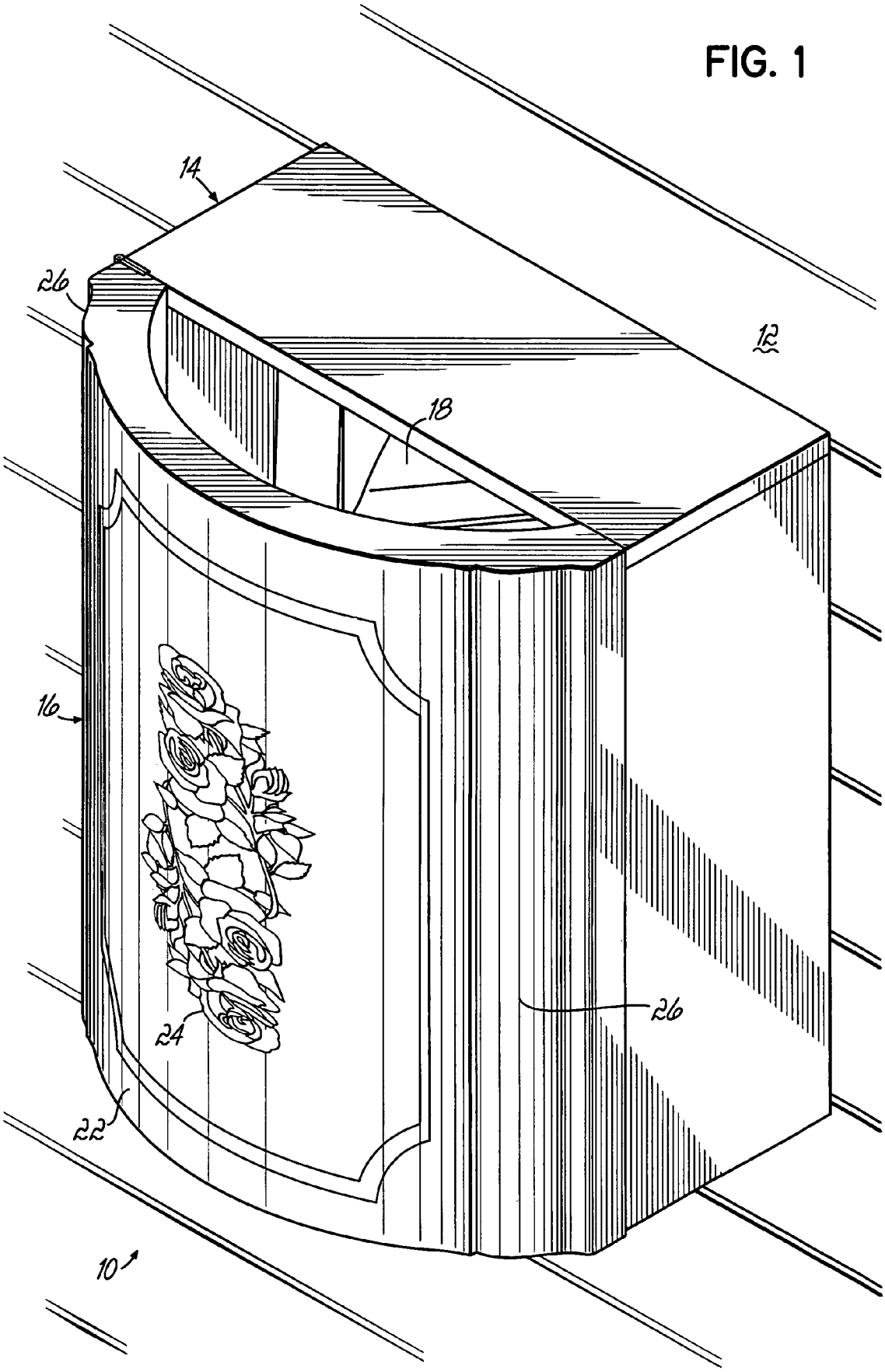
FIG. 1 is a perspective of the display of the present invention.
Figure 2:
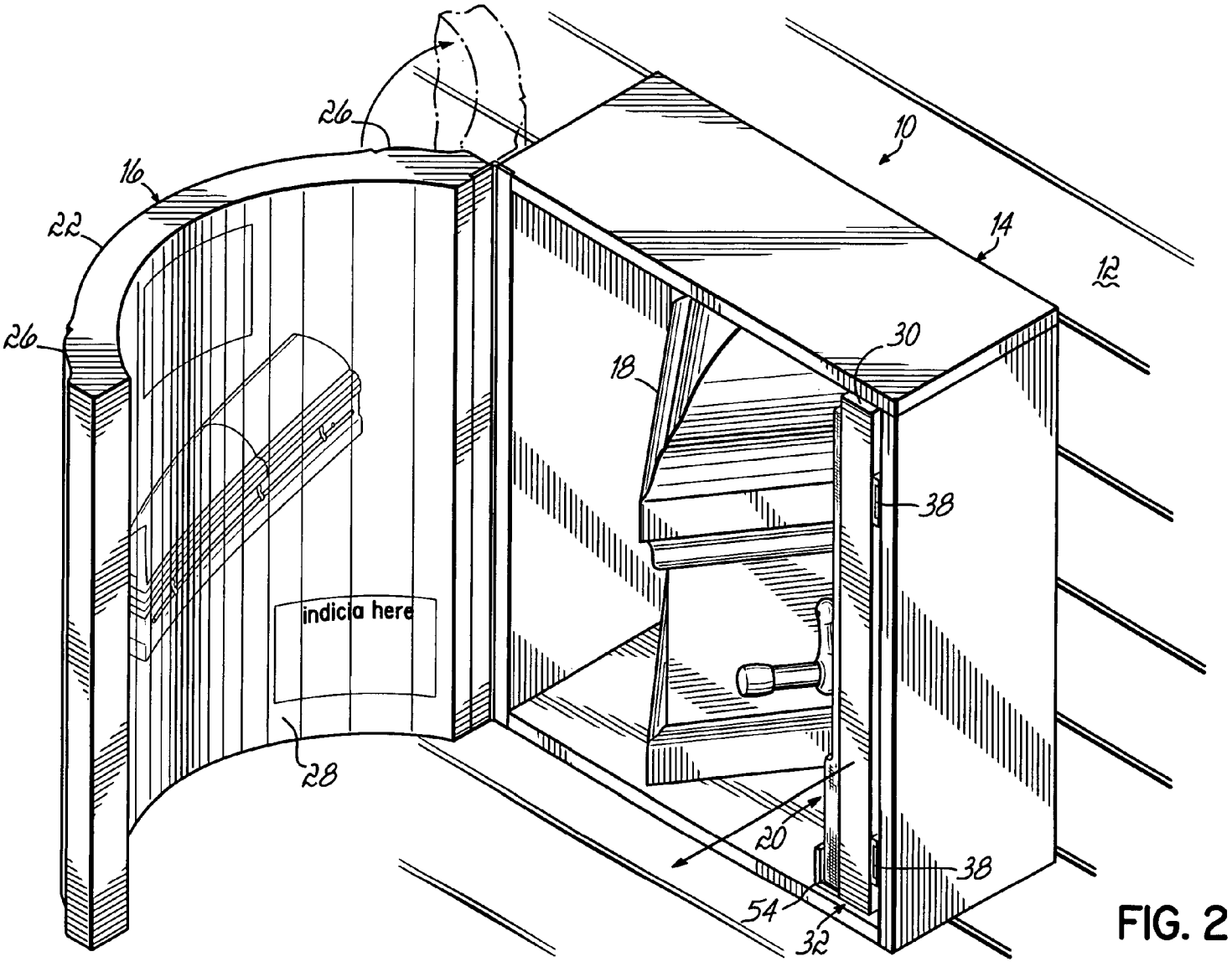
FIG. 2 is a view, similar to FIG. 1, of the display with the door thereof open.
Figure 3:
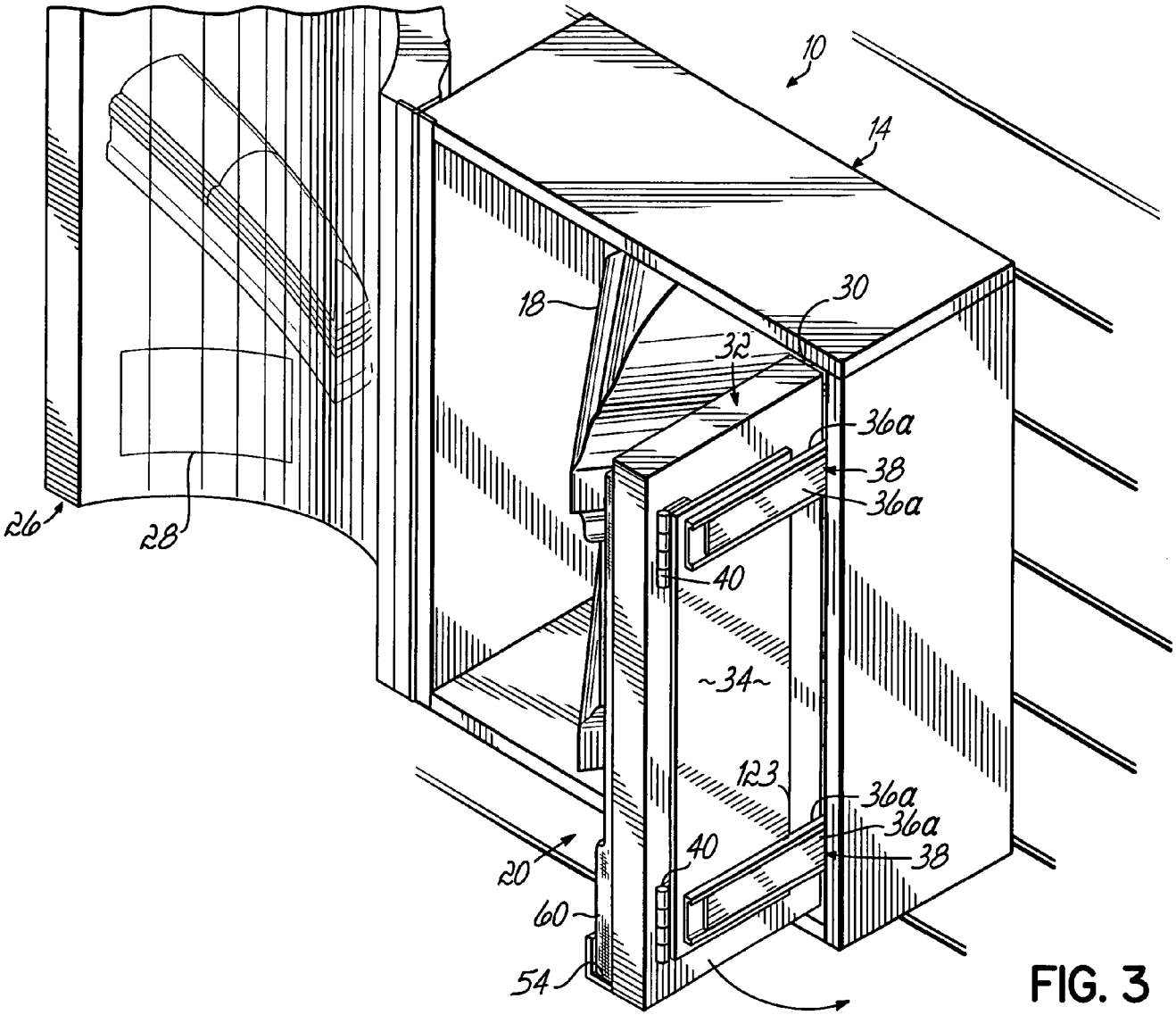
FIG. 3 is a view, similar to FIG. 2, of the display with the door thereof open and the information insert partially withdrawn from its enclosure.

Referring first to FIGS. 1-4, there is illustrated a display 10 according to the principles of the present invention. The display 10 includes a wall 12, for example slat wall, and a cabinet 14 mounted to the wall 12. Cabinet 14 includes an openable and closable door 16 mounted to the cabinet 14 by, for example, hinges. A casket portion 18 is positioned in the cabinet 14 and is revealed upon opening door 16. Casket portion 18 can preferably be a 45° corner cut, but other geometries could be utilized as well. The cabinet 14 can include, but does not necessarily have to include, an information module 20 positioned in the cabinet 14. Information module 20 will be described in more detail below. With like numbers representing like elements, FIG. 5 illustrates an embodiment of the display 10 which does not include information module 20. For illustrative techniques of mounting cabinet 14 to a slat wall, see the assignee's U.S. patent application Ser. Nos. 09/638,576 and 10/611,607.

Door 16 to cabinet 14 is in the appearance of the lid of the casket being displayed by the display 10. That is to say, door 16 can include an arcuate portion or "crown" 22, as is found on a casket lid. The crown 22 can include decorative surface ornamentation 24 thereon, such as, as can be in the case of wood or molded caskets, marquetry. Other surface ornamentation, be it for wood or metal caskets, can be employed, such as painting, engraving, etc. Door 16 can also include side "rim" members 26, 26, also simulative of a casket lid. It is to be understood that door 16 can be fabricated of any suitable molded material, wood or metal, depending on the style of casket to be displayed by the display 10. Cabinet 14 and door 16 can be sized as desired. If cabinet 14 is of a larger size, door 16 can essentially be the same size as a head end or foot end lid of a split-top casket. If cabinet 14 is of a smaller size, door 16 can simply be scaled down to the appropriate size to fit cabinet 14. By being configured into the general appearance of a casket lid, door 16 serves the dual purpose of concealing the contents of cabinet 14 until the customer desires to view same, and providing the customer with a good idea what the actual casket lid and its surface ornamentation will look like on the actual casket to be purchased. Door 16 can also include text and/or graphics 28 on an interior surface thereof which is also revealed upon the customer opening the door 16. (FIG. 2) Such text and/or graphics 28 are to convey additional information about the casket displayed by the display 10.

As mentioned above, display 10 can include an information module 20. Information module 20 can include a portion of the interior of the casket being displayed by the display 10. More particularly, information module 20 can comprise an enclosure 30, either formed in cabinet 14 or formed by cabinet 14, and an information insert 32 movable into and out of the enclosure 30. Insert 32 can comprise a first portion 34 and a second portion 36. The first and second portions 34 and 36 can be movably mounted to the enclosure 30 for translational movement into and out of the enclosure 30. For example, first portion 34 can be mounted to enclosure 30 via a pair of slide mechanisms 38, 38 having portions 36*a*, 36*b* which slide relative to one another. In addition, second insert portion 34 can be movably mounted to first insert portion 32 for pivoting movement therebetween, as by a pair of hinges 40, 40, such that second insert portion 36, once pulled out of enclosure 30, can be pivoted 90° such that its contents then face a customer. Second insert portion 36 can also include a front panel 42 (FIGS. 6 and 7) to cover the opening 44 of the enclosure 30, and a knob 46 facilitating pulling the insert 32 out of the enclosure 30.

Figure 4:
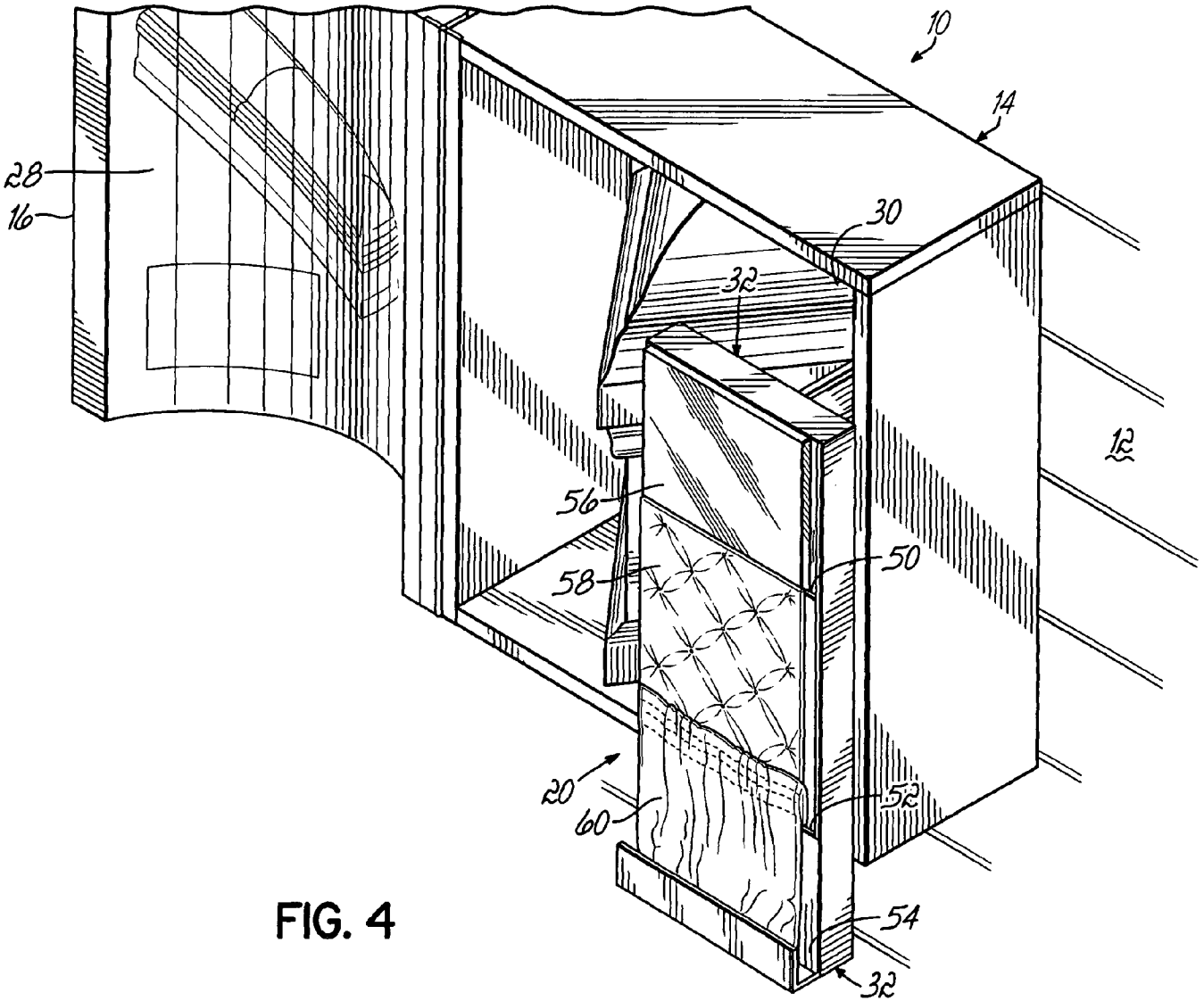
FIG. 4 is a view, similar to FIG. 3, of the display with the door thereof open and the information insert fully withdrawn from its enclosure, and with the second portion of the insert pivoted 90° such that the contents thereof face the customer.
Figure 5:
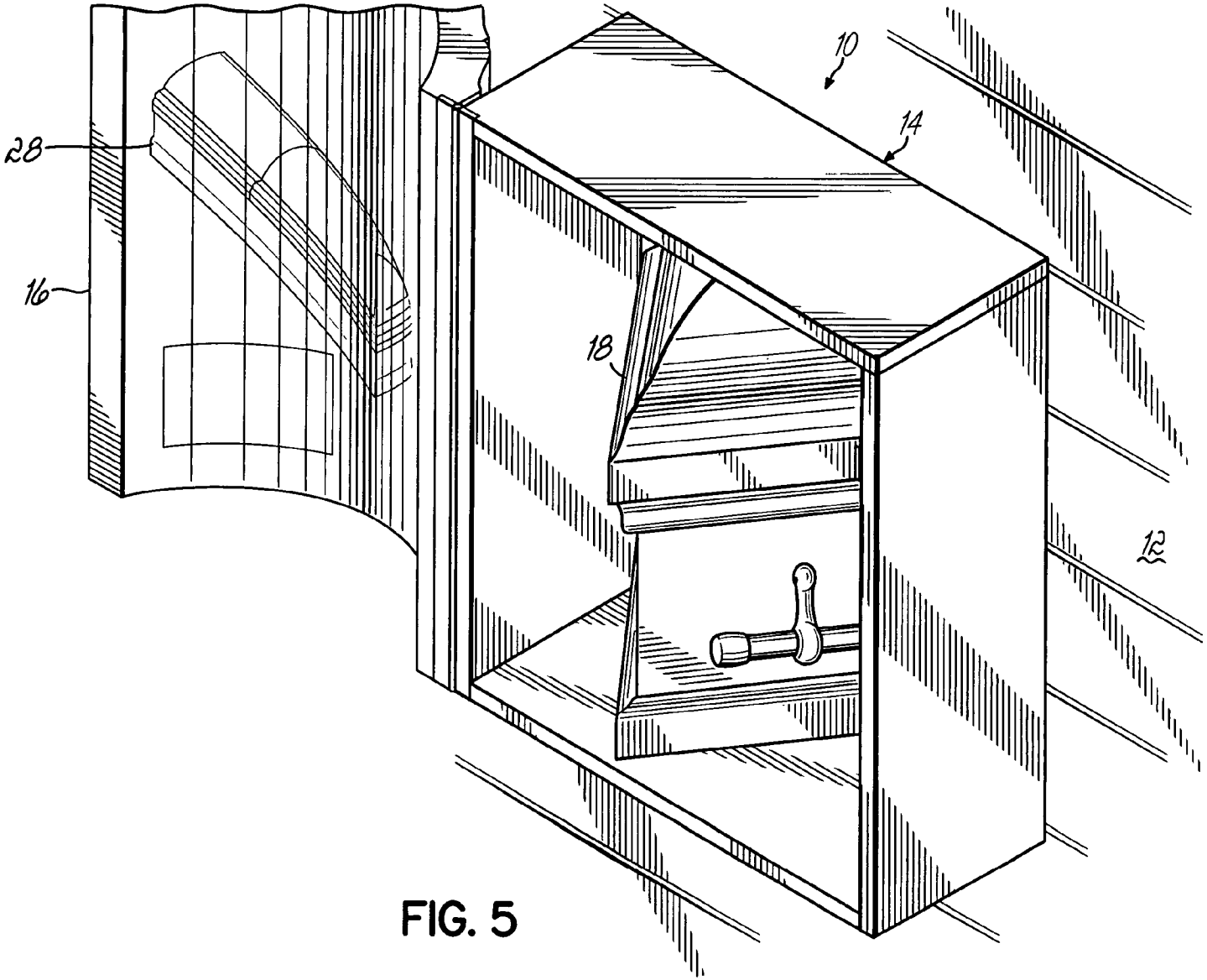
FIG. 5 is a view, similar to FIG. 1, of an alternative embodiment of the present invention.
Figure 7:
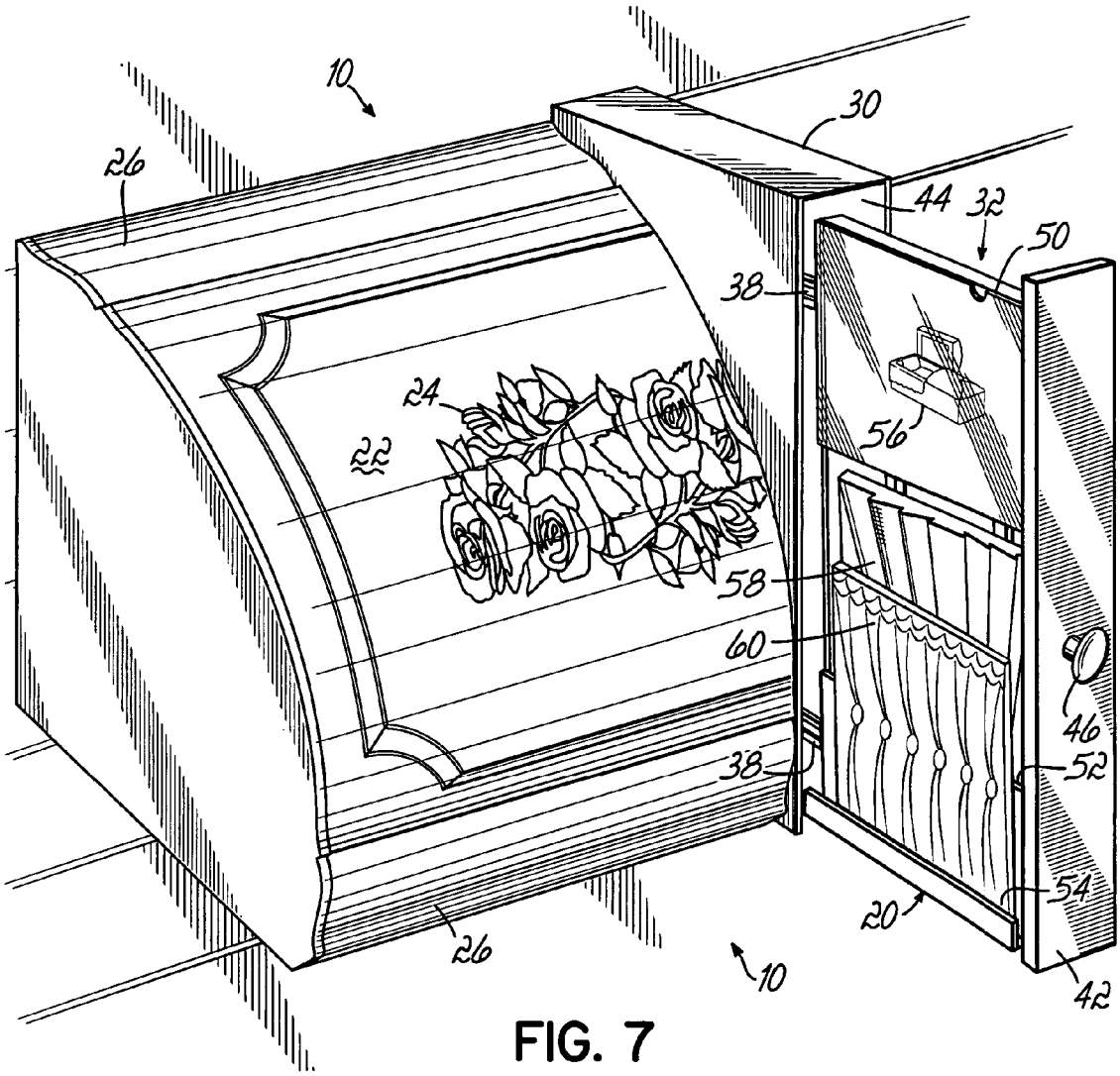
FIG. 7 is a view, similar to FIG. 6, with the information insert withdrawn from its enclosure.

Describing the second portion 36 of the information insert 32 in more detail, and referring now to FIGS. 4 and 7, the second portion 36 is preferably fabricated, at least in part, of a transparent material such as acrylic and includes a first pocket 50, a second pocket 52 and a third pocket 54. The first pocket 50 can include a photo 56 of the casket, the second pocket 52 can include a portion 58 of the cap panel of the casket and the third pocket 54 can include a fabric swatch 60 of the fabric of the casket. Pockets 50, 52 and 54, and photo 56, cap panel portion 58 and fabric swatch 60, are sized such that the customer can readily see, access, touch and feel them. Additionally, or instead, cards (not shown) containing printed information can be positioned in the pockets to thereby provide additional information about the casket.

Figure 6:
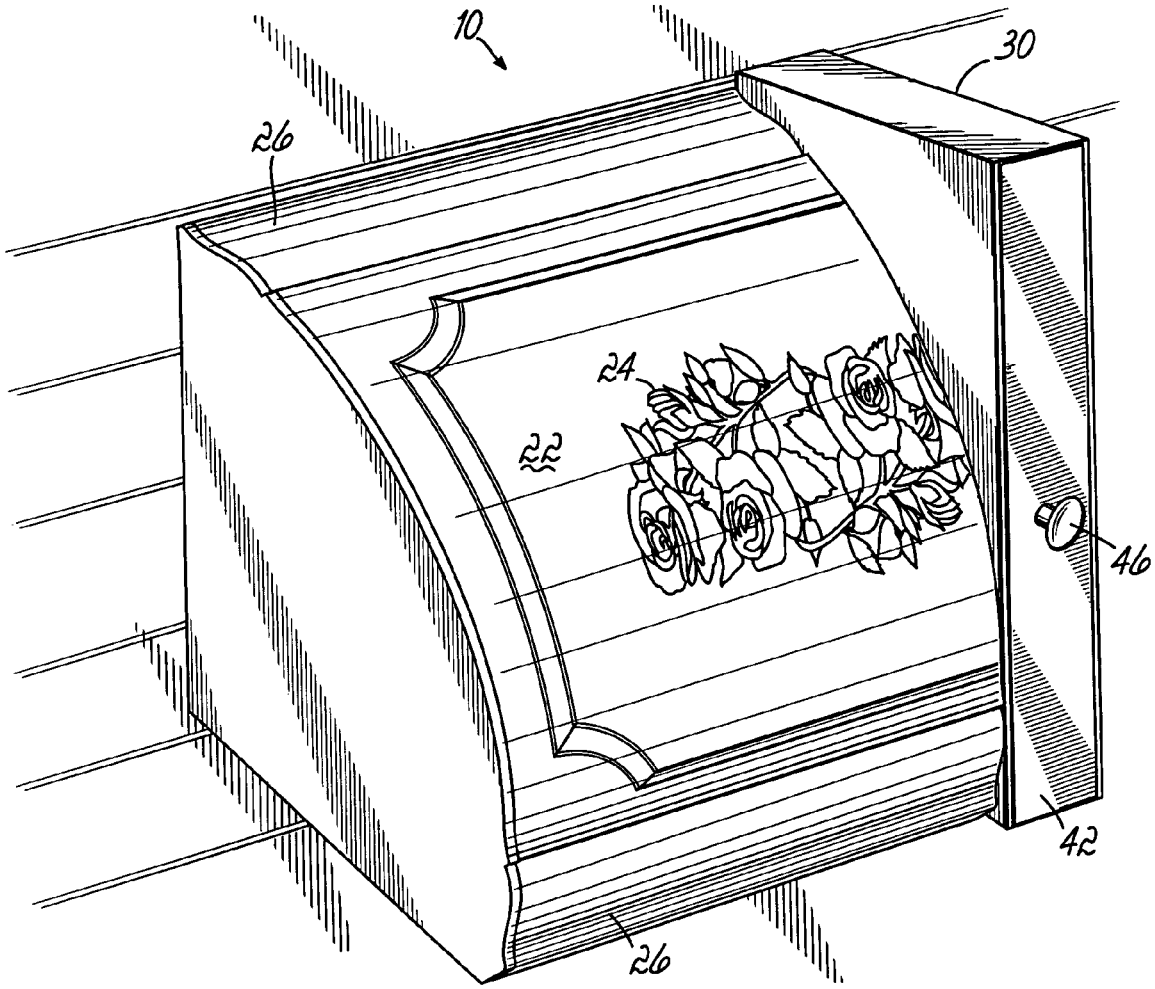
FIG. 6 is a view, similar to FIG. 1, of another alternative embodiment.

Referring now to FIGS. 6 and 7, and with like numbers illustrating like elements, there is illustrated an alternative embodiment of the display 10 of the present invention. In this case, the door 16 which simulates the lid of the casket being displayed is oriented horizontally instead of vertically as in the prior embodiments. In this embodiment, door 16 can be hinged along either the upper or lower edge as desired, and can include the casket portion 18 therebehind (not shown in FIGS. 6 and 7) and information module 20 as desired.

Those skilled in the art will readily recognize numerous adaptations and modifications which can be made to the present invention which will result in an improved casket selection room display, yet all of which will fall within the spirit and scope of the present invention as defined in the following claims. Accordingly, the invention shall embrace all such variations and is to be limited only by the scope of the following claims and their equivalents.

What is claimed is:

1. A display for displaying features of a casket, the casket having a shell, a lid and an interior, said display comprising:
- a wall,
- a cabinet mounted to said wall,
- an openable and closable first door mounted to said cabinet, said first door configured so as to have the appearance of being at least a portion of the lid of the casket, and
- at least a portion of the shell of the casket positioned in said cabinet,
- further including an information module positioned in said cabinet, said information module containing at least a portion of the interior of the casket,
- wherein said information module includes at least one of a photo of the casket, a portion of a cap panel of the casket and a fabric swatch of the casket,
- wherein said information module comprises an enclosure and an information insert movable into and out of said enclosure,
- wherein said information insert comprises a first portion and a second portion, said first and second insert portions movably mounted to said enclosure for translational movement into and out of said enclosure, said second insert portion movably mounted to said first insert portion for pivoting movement therebetween, whereby said second insert portion can be pulled out of said enclosure and then pivoted 90° such that the contents of said information insert then face the customer.

2. The display of claim 1 wherein said first door is fabricated from wood.

3. The display of claim 2 wherein an exterior surface of said first door includes marquetry thereon.

4. The display of claim 1 wherein said enclosure includes a second door pivotable to and between a closed position and an open position.

5. The display of claim 1 wherein said second insert portion is fabricated at least in part of a transparent material and comprises:
- a first pocket having upper and lower edges,
- a second pocket attached to said upper edge of said first pocket, and
- a third pocket attached to said lower edge of said first pocket.

6. The display of claim 5 wherein said first pocket includes therein a portion of a cap panel of the casket, said second pocket includes therein a photo of the casket and said third pocket includes therein a fabric swatch of the casket.

7. The display of claim 1 wherein said at least a portion of the shell of the casket is a 45° corner cut.

8. The display of claim 7 wherein said 45° corner cut is of the shell and lid of the casket.

9. The display of claim 1 wherein said first door includes at least one of graphics and text on an interior surface thereof relating to the casket.

10. The display of claim 1 wherein said wall is slat wall.

11. A display for displaying features of a casket, the casket having a shell, a lid and an interior, said display comprising:
- a wall,
- a cabinet mounted to said wall,
- an openable and closable first door mounted to said cabinet, said door configured so as to have the appearance of being at least a portion of the lid of the casket,
- at least a portion of the shell of the casket positioned in said cabinet, and
- at least a portion of the interior of the casket positioned in said cabinet,
- further including an information module positioned in said cabinet, said information module containing said at least a portion of the interior of the casket,
- wherein said information module includes at least one of a photo of the casket, a portion of a cap panel of the casket and a fabric swatch of the casket,
- wherein said information module comprises an enclosure and an information insert movable into and out of said enclosure,
- wherein said information insert comprises a first portion and a second portion, said first and second insert portions movably mounted to said enclosure for translational movement into and out of said enclosure, said second insert portion movably mounted to said first insert portion for pivoting movement therebetween, whereby said second insert portion can be pulled out of said enclosure and then pivoted 90° such that the contents of said information insert then face the customer.

12. The display of claim 11 wherein said first door is fabricated from wood.

13. The display of claim 12 wherein an exterior surface of said first door includes marquetry thereon.

14. The display of claim 11 wherein said enclosure includes a second door pivotable to and between a closed position and an open position.

15. The display of claim 11 wherein said second insert portion is fabricated at least in part of a transparent material and comprises:

a first pocket having upper and lower edges, a second pocket attached to said upper edge of said first pocket, and a third pocket attached to said lower edge of said first pocket.

16. The display of claim 15 wherein said first pocket includes therein a portion of a cap panel of the casket, said second pocket includes therein a photo of the casket and said third pocket includes therein a fabric swatch of the casket.

17. The display of claim 11 wherein said at least a portion of the shell of the casket is a 45° corner cut.

18. The display of claim 11 wherein said 45° corner cut is of the shell and lid of the casket.

19. The display of claim 11 wherein said first door includes at least one of graphics and text on an interior surface thereof relating to the casket.

20. The display of claim 11 wherein said wall is slat wall.

21. A display for a casket selection room comprising:

a wall, a plurality of cabinets mounted to said wall, a plurality of casket portions representing a plurality of caskets from which a customer may select, each of said plurality of casket portions positioned in one of said plurality of cabinets, and an openable and closable first door mounted to each of said plurality of cabinets, said first door configured so as to have the appearance of being at least a portion of a lid of the casket, further including an information module positioned in each of said plurality of cabinets, said information module containing at least a portion of an interior of the casket, wherein said information module includes at least one of a photo of the casket, a portion of a cap panel of the casket and a fabric swatch of the casket, wherein said information module comprises an enclosure and an information insert movable into and out of said enclosure, wherein said information insert comprises a first portion and a second portion, said first and second insert portions movably mounted to said enclosure for translational movement into and out of said enclosure, said second insert portion movably mounted to said first insert portion for pivoting movement therebetween, whereby said second insert portion can be pulled out of said enclosure and then pivoted 90° such that the contents of said information insert then face the customer.

22. The display of claim 21 wherein said first door is fabricated from wood.

23. The display of claim 22 wherein an exterior surface of said first door includes marquetry thereon.

24. The display of claim 21 wherein said enclosure includes a second door pivotable to and between a closed position and an open position.

25. The display of claim 21 wherein said second insert portion is fabricated at least in part of a transparent material and comprises:

a first pocket having upper and lower edges, a second pocket attached to said upper edge of said first pocket, and a third pocket attached to said lower edge of said first pocket.

26. The display of claim 25 wherein said first pocket includes therein a portion of a cap panel of the casket, said second pocket includes therein a photo of the casket and said third pocket includes therein a fabric swatch of the casket.

27. The display of claim 21 wherein each of said plurality of casket portions is a 45° corner cut.

28. The display of claim 21 wherein said door includes at least one of graphics and text on an interior surface thereof relating to the casket.

29. The display of claim 21 wherein said wall is slat wall.

30. A display for a casket selection room comprising:

a wall, a plurality of cabinets mounted to said wall, a plurality of casket portions representing a plurality of caskets from which a customer may select, each of said plurality of casket portions positioned in one of said plurality of cabinets, a plurality of casket interior portions representing a plurality of casket interiors from which a customer may select, each of said plurality of casket interior portions positioned in one of said plurality of cabinets, and an openable and closable first door mounted to each of said plurality of cabinets, said first door configured so as to have the appearance of being at least a portion of a lid of the casket, further including an information module positioned in each of said plurality of cabinets, said information module containing said casket interior portion, wherein said information module includes at least one of a photo of the casket, a portion of a cap panel of the casket and a fabric swatch of the casket, wherein said information module comprises an enclosure and an information insert movable into and out of said enclosure, wherein said information insert comprises a first portion and a second portion, said first and second insert portions movably mounted to said enclosure for translational movement into and out of said enclosure, said second insert portion movably mounted to said first insert portion for pivoting movement therebetween, whereby said second insert portion can be pulled out of said enclosure and then pivoted 90° such that the contents of said information insert then face the customer.

31. The display of claim 30 wherein said first door is fabricated from wood.

32. The display of claim 30 wherein an exterior surface of said first door includes marquetry thereon.

33. The display of claim 30 wherein said enclosure includes a second door pivotable to and between a closed position and an open position.

34. The display of claim 30 wherein said second insert portion is fabricated at least in part of a transparent material and comprises:

a first pocket having upper and lower edges, a second pocket attached to said upper edge of said first pocket, and a third pocket attached to said lower edge of said first pocket.

35. The display of claim 30 wherein said first pocket includes therein a portion of a cap panel of the casket, said second pocket includes therein a photo of the casket and said third pocket includes therein a fabric swatch of the casket.

36. The display of claim 30 wherein each of said plurality of casket portions is a 45° corner cut.

37. The display of claim 30 wherein said door includes at least one of graphics and text on an interior surface thereof relating to the casket.

38. The display of claim 30 wherein said wall is slat wall.

39. A display for displaying features of a casket, the casket having a shell, a lid and an interior, said display comprising:

a cabinet adapted to be mounted to a wall, an openable and closable door mounted to said cabinet, said door configured so as to have the appearance of being at least a portion of the lid of the casket and to visually conceal contents of said cabinet when closed, and at least one of at least a portion of the shell of the casket and at least a portion of the interior of the casket positioned in said cabinet.

40. The display of claim 39 wherein said cabinet contains both the at least a portion of the shell of the casket and the at least a portion of the interior of the casket.

41. The display of claim 39 further comprising an information module positioned in said cabinet, said information module containing the at least one of the at least a portion of the shell of the casket and the at least a portion of the interior of the casket.

42. The display of claim 41 wherein said information module comprises an enclosure and an information insert that translates into and out of said enclosure and that pivots 90° when outside of said enclosure to face a customer, said information insert carrying both the at least a portion of the shell of the casket and the at least a portion of the interior of the casket.

43. The display of claim 41 wherein said cabinet and door are mounted generally vertically.

44. The display of claim 39 further comprising an information module positioned alongside said cabinet, said information module containing the at least one of the at least a portion of the shell of the casket and the at least a portion of the interior of the casket.

45. The display of claim 44 wherein said information module comprises an enclosure and an information insert that translates into and out of said enclosure and that pivots 90° when outside of said enclosure to face a customer, said information insert carrying both the at least a portion of the shell of the casket and the at least a portion of the interior of the casket.

46. The display of claim 44 wherein said cabinet and door are mounted generally horizontally.

* * * * *